US012055345B2

(12) United States Patent
Prosser et al.

(10) Patent No.: US 12,055,345 B2
(45) Date of Patent: Aug. 6, 2024

(54) AIR SEPARATION UNIT AND METHOD FOR PRODUCTION OF NITROGEN AND ARGON USING A DISTILLATION COLUMN SYSTEM WITH AN INTERMEDIATE PRESSURE KETTLE COLUMN

(71) Applicants: Neil M. Prosser, Lockport, NY (US); James R. Handley, East Amherst, NY (US)

(72) Inventors: Neil M. Prosser, Lockport, NY (US); James R. Handley, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 277 days.

(21) Appl. No.: 17/875,616

(22) Filed: Jul. 28, 2022

(65) Prior Publication Data

US 2024/0035744 A1 Feb. 1, 2024

(51) Int. Cl.
*F25J 3/00* (2006.01)
*F25J 3/04* (2006.01)

(52) U.S. Cl.
CPC ..... *F25J 3/04709* (2013.01); *F25J 3/04448* (2013.01); *F25J 2200/08* (2013.01); *F25J 2210/40* (2013.01); *F25J 2215/42* (2013.01); *F25J 2215/58* (2013.01)

(58) Field of Classification Search
CPC .. F25J 2200/08; F25J 2200/54; F25J 2200/92; F25J 2210/40; F25J 2215/42; F25J 2215/58; F25J 2235/50; F25J 2245/40; F25J 2245/50; F25J 3/04084; F25J 3/0409; F25J 3/04212; F25J 3/0423; F25J 3/04296; F25J 3/04303; F25J 3/04448; F25J 3/04709; F25J 3/04727; F25J 3/04884
See application file for complete search history.

(56) References Cited

U.S. PATENT DOCUMENTS 4,822,395 A 4/1989 Cheung
5,114,449 A 5/1992 Agrawal et al.
5,129,932 A 7/1992 Agrawal et al.
(Continued)

FOREIGN PATENT DOCUMENTS

EP 1231440 A1 8/2002
FR 2787559 A1 6/2000
(Continued)

*Primary Examiner* — Filip Zec
(74) *Attorney, Agent, or Firm* — Robert J. Hampsch

(57) ABSTRACT

An air separation unit and associated method for separating air by cryogenic distillation using a distillation column system including a higher pressure column, a lower pressure column, an intermediate pressure kettle column, and an argon column arrangement is provided. The disclosed air separation unit and method is particularly suited for production of an argon product as well as several nitrogen products wherein a portion of the nitrogen overhead intermediate pressure kettle column is taken as an intermediate or elevated pressure nitrogen product. The present air separation unit and associated method employs a once-through kettle column reboiler, a once-through kettle column condenser while the argon condenser condenses an argon-rich vapor stream against a pumped oxygen stream from the bottom of the lower pressure column.

12 Claims, 4 Drawing Sheets

(56) References Cited

U.S. PATENT DOCUMENTS

| | | | | |
|---|---|---|---|---|
| 5,255,524 | A | 10/1993 | Agrawal et al. | |
| 5,657,644 | A | 8/1997 | Oakey et al. | |
| 5,675,977 | A | 10/1997 | Prosser | |
| 5,862,680 | A | 1/1999 | Higginbotham et al. | |
| 6,009,723 | A | 1/2000 | Fidkowski et al. | |
| 6,227,005 | B1 | 5/2001 | Higginbotham et al. | |
| 6,536,232 | B2 | 3/2003 | Davidian et al. | |
| 8,286,446 | B2 * | 10/2012 | Howard | F25J 3/04424 62/646 |
| 8,480,860 | B2 * | 7/2013 | Kovak | F25J 3/04909 202/205 |
| 8,695,377 | B2 * | 4/2014 | Bachelier | F25J 3/04296 62/643 |
| 9,726,427 | B1 * | 8/2017 | Narinsky | F25J 3/04393 |
| 10,018,413 | B2 * | 7/2018 | Du | F25J 3/04303 |
| 10,480,853 | B2 * | 11/2019 | Lautenschlager | F25J 3/04412 |
| 10,663,222 | B2 | 5/2020 | Kromer et al. | |
| 10,663,223 | B2 | 5/2020 | Handley et al. | |
| 10,663,224 | B2 | 5/2020 | Prosser et al. | |
| 10,746,461 | B2 * | 8/2020 | Allam | F25J 3/04018 |
| 10,816,263 | B2 | 10/2020 | Prosser et al. | |
| 10,969,168 | B2 | 4/2021 | Kromer et al. | |
| 11,103,804 | B2 * | 8/2021 | Buttridge | B01D 3/143 |
| 11,262,125 | B2 * | 3/2022 | Prosser | F25J 3/04236 |
| 2002/0178747 | A1 | 12/2002 | Pompl | |
| 2007/0209389 | A1 * | 9/2007 | Prosser | F25J 3/042 62/646 |
| 2014/0249023 | A1 * | 9/2014 | Barrett | C01B 23/0078 502/68 |
| 2015/0114037 | A1 | 4/2015 | Prosser | |
| 2015/0253075 | A1 | 9/2015 | Davidian et al. | |
| 2017/0211881 | A1 * | 7/2017 | Xu | F25J 3/04218 |
| 2018/0231305 | A1 * | 8/2018 | Pierre, Jr. | F25J 1/0035 |
| 2019/0204009 | A1 * | 7/2019 | Prosser | F25J 3/04412 |
| 2019/0331416 | A1 * | 10/2019 | Prosser | F25J 3/04715 |
| 2019/0331418 | A1 | 10/2019 | Prosser et al. | |
| 2020/0149807 | A1 * | 5/2020 | Kromer | F25J 3/04727 |
| 2023/0050296 | A1 * | 2/2023 | Xu | F25J 3/04412 |

FOREIGN PATENT DOCUMENTS

| | | | |
|---|---|---|---|
| FR | 2819046 | A1 | 7/2002 |
| FR | 2837564 | A1 | 9/2003 |

* cited by examiner

AIR SEPARATION UNIT AND METHOD FOR PRODUCTION OF NITROGEN AND ARGON USING A DISTILLATION COLUMN SYSTEM WITH AN INTERMEDIATE PRESSURE KETTLE COLUMN

TECHNICAL FIELD

The present system and method relates to separating air by cryogenic distillation, and more particularly, to an air separation unit and method tailored for producing nitrogen and argon product streams, including elevated pressure nitrogen product streams from a distillation column system. The present system and method employs a higher pressure column, a lower pressure column, an intermediate pressure kettle column, and an argon column arrangement.

BACKGROUND

The conventional air separation cycle employing a higher pressure column, a lower pressure and an argon column is the standard choice for an air separation unit when the oxygen product is needed at 99.5% purity or higher, which is often referred to as 'normal purity oxygen' together with an argon product. However, for normal purity oxygen and argon production, a three column arrangement exhibits a significant operational deficiency, as illustrated in the McCabe-Thiele diagram of FIG. 1.

McCabe-Thiele diagrams are instructive because they illustrate the magnitude of the mass transfer driving forces in the distillation columns of an air separation unit. A McCabe-Thiele diagram for the lower pressure column is key for analysis of a cryogenic oxygen based air separation process. The space in a McCabe-Thiele diagram between the equilibrium line and the operating line is indicative of the driving force for that portion of the column. A process that has large distillation driving forces will tend to have short distillation columns (i.e. not many stages of separation), but it will also be high in power consumption. Ideally, a very efficient cryogenic distillation process will have close, and fairly constant, approaches between the operating line and the equilibrium line. A McCabe-Thiele diagram normally plots the light key component in the liquid on the x-axis and the light key component in the vapor on the y-axis. In FIG. 1, the sum of the nitrogen and argon compositions for the liquid and the vapor are plotted on each axis. Argon is the light key in the bottom section of the lower pressure column while nitrogen is the light key in the rest of the lower pressure column. By plotting the sum of argon and nitrogen fractions in FIG. 1, the entire lower pressure column can be fairly characterized.

The McCabe-Thiele diagram illustrated in FIG. 1, depicts a scenario with a conventional three column arrangement and cycle where the flow rate of elevated pressure nitrogen product is about the same flow rate of oxygen product. The result is the lower pressure column separation is challenged. As a result, the McCabe-Thiele diagram shows a virtual pinch near the top, at an x-axis value of about 0.77. The addition of liquid air to the lower pressure column relieves this virtual pinch.

A feature of most conventional three column arrangements producing normal purity oxygen is the tight approach between the equilibrium line and the operating line in the bottom section of the lower pressure column depicted in the McCabe-Thiele diagram of FIG. 1. This is because the oxygen and argon have close relative volatilities. Thus, the removal of argon from oxygen that takes place in the bottom section of the lower pressure column is the most difficult separation among the three standard components of air. Note that without sufficient vapor boil-up in the lower pressure column produced by the main condenser-reboiler at the bottom of the lower pressure column, the slope of the operating line would be lower. The resulting compositional pinch would lead to much poorer oxygen recovery and much higher power consumption to produce that oxygen.

Note, that in FIG. 1, there is a large difference between the operating line and equilibrium line in the section of the lower pressure column between the kettle liquid feed and argon column draw. This always occurs and it results from the need for the high liquid to vapor ratio (LN) in the bottom section of the lower pressure column. Also, there is a relatively large difference between the operating line and equilibrium line in the section between the liquid air feed and the kettle liquid feed. This means that these sections of the lower pressure column have a large mass transfer driving force, which is generally unavoidable in a three column arrangement and cycle producing normal purity oxygen and argon.

Another key observation with respect to the conventional three column arrangement is that the production of high quality nitrogen reflux by the higher pressure column is limited by the equilibrium between the feed air and the kettle liquid. That is, even if the higher pressure column contains a very high number of stages, the amount of reflux generated for supply to the lower pressure column will be limited. The equilibrium between the feed air and kettle liquid necessarily means that a large amount of nitrogen escapes in the kettle liquid and cannot be converted into nitrogen reflux in conventional three column arrangements.

To address these problems, the use of an intermediate pressure column, or kettle column has been suggested. In the intermediate pressure column, the kettle liquid from the higher pressure column is further fractionated to produce additional nitrogen reflux. Examples of the intermediate pressure column are disclosed in U.S. Pat. Nos. 5,675,977; 5,657,644; 5,862,680; and 6,536,232.

U.S. Pat. No. 5,675,977 discloses the use of an intermediate pressure column for the production of low purity oxygen, where the intermediate pressure column is driven with nitrogen vapor from the higher pressure column. By diverting a portion of nitrogen vapor from the higher pressure column to the intermediate pressure column re-boiler, the loss of nitrogen boil-up in the lower pressure column is perfectly tolerable for low purity oxygen production. However, this configuration is not suitable for normal purity oxygen production, where all the available nitrogen gas from the higher pressure column must be used in the main condenser-reboiler to produce sufficient nitrogen vapor boil-up in the lower pressure column. Also note that U.S. Pat. No. 5,675,977 does not disclose the production of any argon product and therefore the disclosed cycle has limited utility due to the lack of argon production.

U.S. Pat. No. 5,657,644 discloses an air separation unit and cycle that employs a higher pressure column, a lower pressure column, an intermediate pressure column, and an argon column that is configured to produce a liquid or crude argon product, a pumped oxygen product and a low pressure nitrogen product taken from the overhead of the lower pressure column. In the four column arrangement disclosed in U.S. Pat. No. 5,657,644, a stream of kettle liquid from the higher pressure column is introduced into a lower section of the intermediate pressure column which produces an oxygen-enriched liquid bottoms and a nitrogen enriched overhead. The intermediate pressure column also includes a bottom reboiler heated by an argon-oxygen containing stream from the lower pressure column and an overhead condenser that condenses a portion of the nitrogen enriched overhead against a portion of the oxygen-enriched liquid bottoms. Another portion of the oxygen-enriched liquid bottoms drives the argon condenser disposed above the argon column while the remaining portion of the oxygen-enriched liquid bottoms is returned to the lower pressure column.

While the air separation cycle disclosed in U.S. Pat. No. 5,657,644 is economically advantageous compared to conventional three column air separation units in that there is a reduced total power consumption as well as an increased argon recovery and oxygen recovery, there is a continuing need to find further improvements to further reduce the total power consumption and provide additional product flexibility, that includes a crude argon product or a refined argon product.

Another example is disclosed in U.S. Pat. No. 6,536,232 which also discloses an air separation unit that employs a higher pressure column, a lower pressure column, an intermediate pressure column, but without an argon column. The intermediate pressure column includes a bottom reboiler heated by an argon-oxygen containing stream from the lower pressure column and an overhead condenser that condenses a portion of the nitrogen enriched overhead against a portion of the oxygen-enriched liquid bottoms. Another portion of the oxygen-enriched liquid bottoms is returned to the lower pressure column.

The air separation cycle disclosed in U.S. Pat. No. 6,536,232 differs from the air separation cycle disclosed in U.S. Pat. No. 5,657,644 mainly due to the absence of the argon column and no production of argon. As indicated above, such improved air separation cycle has limited utility because there is no argon production as well as limited nitrogen production.

The above-described prior art systems are specifically tailored for oxygen producing air separation units and there has been no configurations proposed for argon and nitrogen producing air separation units. U.S. Pat. No. 4,822,395 (Cheung) as well as more recent U.S. Pat. Nos. 10,663,222; 10,663,223; 10,663,224; 10,816,263; and 10,969,168 disclose three column air separation units and associated cycles that focus on production of nitrogen and argon.

What is needed is further enhancements to nitrogen and argon producing air separation units and cycles to potentially reduce operating costs while concurrently improving argon recovery and ensuring sufficient availability of higher purity nitrogen product streams.

SUMMARY

The present invention may be broadly characterized as an air separation unit for the production of nitrogen and argon products from a source of purified, compressed feed air. The present air separation unit comprises: a main air compression arrangement; a pre-purification unit, a main heat exchanger, a turbine air circuit configured to expand one of the cooled streams of purified, compressed air to produce an exhaust stream that is directed to the lower pressure column; and a distillation column system.

More specifically, the distillation column system of the nitrogen and argon producing air separation unit comprises: (i) a higher pressure column configured to receive the air steam and a first reflux stream and yield a nitrogen-rich overhead and a kettle liquid; (ii) a lower pressure column configured to receive the exhaust stream and a second reflux stream and yield a low pressure product grade nitrogen overhead, an oxygen liquid bottoms, and an argon-oxygen side stream; (iii) a main condenser-reboiler disposed in the lower pressure column and configured for thermally coupling the higher pressure column and the lower pressure column by liquefying at least a portion of the nitrogen-rich overhead from the higher pressure column against oxygen liquid bottoms in the lower pressure column to yield the first reflux stream and the second reflux stream; (iv) an intermediate pressure kettle column arrangement comprising a kettle column configured to receive the kettle liquid from the higher pressure column at an intermediate location of the kettle column and yield an oxygen-rich bottoms and a nitrogen rich overhead; and (v) an argon column arrangement comprising one or more argon columns and an argon condenser, the argon column is configured to receive a second part of the argon-oxygen side stream from the lower pressure column and yield an argon-rich overhead and an oxygen-rich liquid stream that is returned to the intermediate location of the lower pressure column. The argon condenser is configured to condense the argon overhead against a portion of the oxygen liquid bottoms from the lower pressure column.

The intermediate pressure kettle column arrangement further comprises a once-through kettle column reboiler and a once through kettle column condenser. The kettle column reboiler is configured to boil a portion of the descending liquid in the kettle column against a first part of the argon-oxygen side stream to yield an ascending vapor stream in the kettle column and an argon-oxygen liquid stream that is returned to an intermediate location of the lower pressure column. The once through kettle column condenser configured to condense all or a portion of the nitrogen rich overhead of the kettle column against a portion of the oxygen-rich bottoms of the kettle column.

In some embodiments of the air separation unit, a portion of the nitrogen-rich overhead of the kettle column is warmed in the main heat exchanger and taken as an intermediate pressure nitrogen vapor product stream while a portion of the nitrogen-rich overhead from the higher pressure column is warmed in main heat exchanger taken as a higher pressure nitrogen vapor product stream ensuring an adequate production of elevated pressure nitrogen products at required purities.

In some embodiments of the above-described air separation unit, a stream of liquid oxygen may be drained from the argon condenser or is taken from the argon condenser and directed to the bottom of the lower pressure column. If recycled to the lower pressure column, a gel trap is preferably disposed between the argon condenser and the lower pressure column to remove heavy impurities from the stream of liquid oxygen taken from the argon condenser.

The use of the intermediate kettle column to further fractionate the kettle liquid provides an additional source of reflux liquid nitrogen to be directed to the lower pressure column. The increase in reflux liquid nitrogen directed to the lower pressure column enables the air separation unit to achieve very high product nitrogen purities. It is possible to design the intermediate pressure kettle column to produce more liquid nitrogen than is needed to meet customer requirements for high purity nitrogen such that a portion of the gaseous nitrogen product stream gas can be taken or withdrawn from the higher pressure column and/or the intermediate pressure kettle column resulting in a power reduction compared to the prior art nitrogen and argon producing air separation units discussed above. Also, the high argon recovery of the present four column arrangement for argon and nitrogen producing air separation units is further improved compared to the prior art nitrogen and argon producing air separation units referenced above.

BRIEF DESCRIPTION OF THE DRAWINGS

It is believed that the claimed invention will be better understood when taken in connection with the accompanying drawings in which:

DETAILED DESCRIPTION

Figure 3:
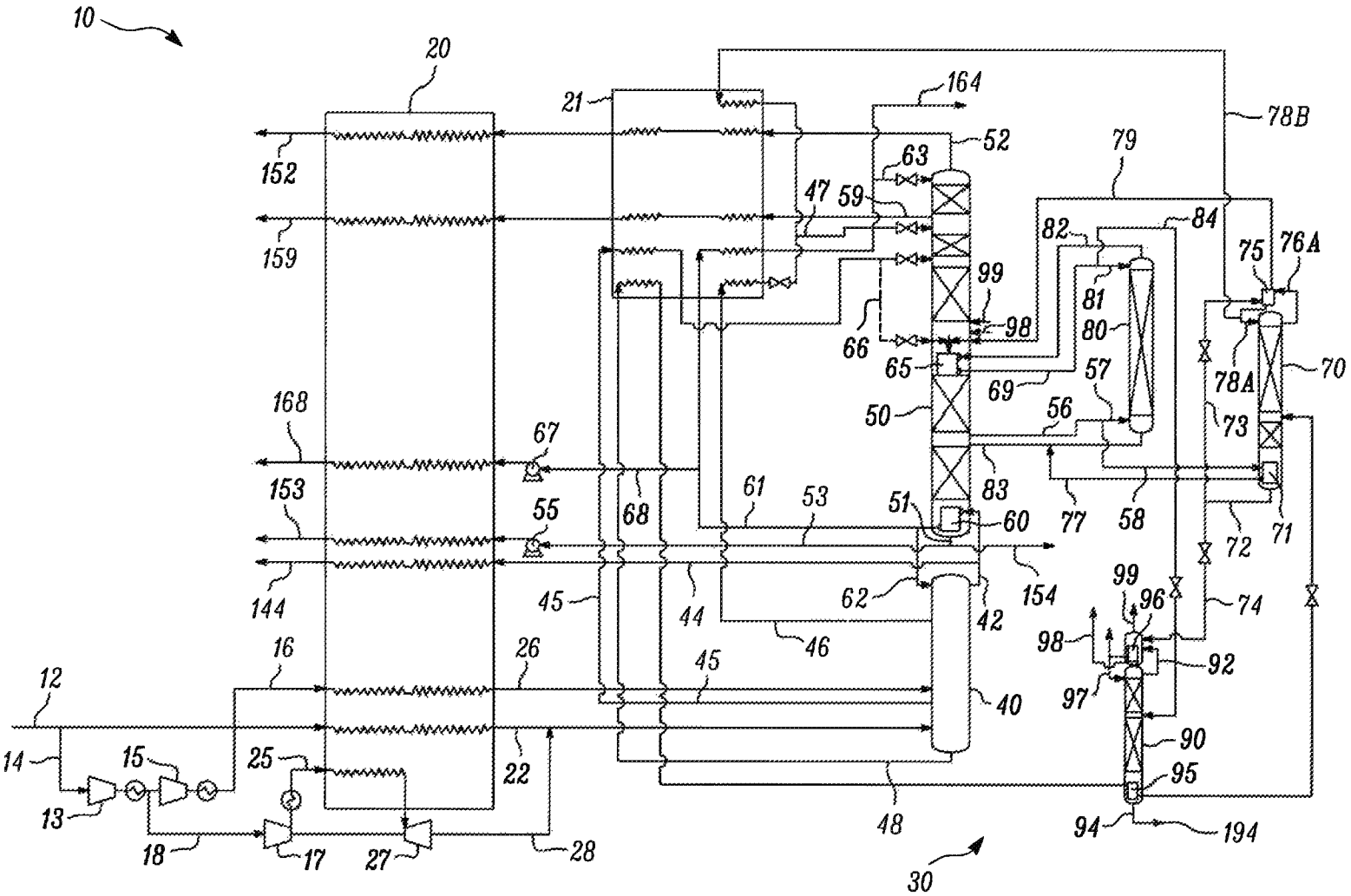
FIG. 3 shows a schematic of the process flow diagram for an oxygen producing air separation unit having a distillation column system that includes an intermediate pressure kettle column.

The disclosed air separation unit and method for separating air by cryogenic distillation using a four column arrangement shown in FIG. 3 includes a higher pressure column, a lower pressure column, an intermediate pressure column, and an argon column arrangement and is particularly suited for production of normal purity oxygen, argon and one or more nitrogen products where the nitrogen production rate of elevated pressure nitrogen gas product and/or liquid nitrogen product exceeds 50% of the total normal purity oxygen production rate.

Figure 1:
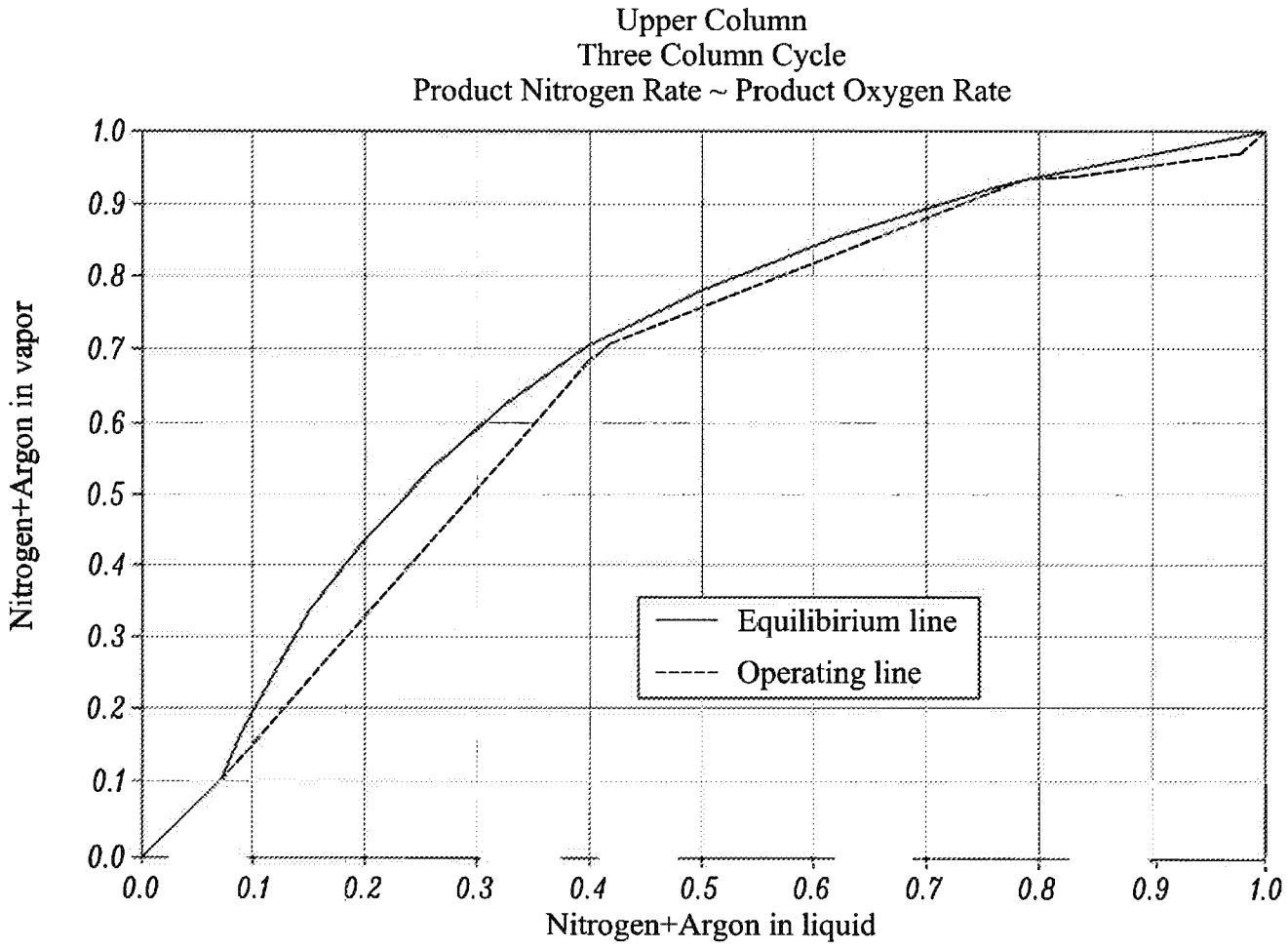
FIG. 1 (Prior Art)
FIG. 1 depicts a McCabe-Thiele diagram for a conventional three column arrangement and cycle known in the prior art where the flow rate of elevated pressure nitrogen product is about the same flow rate of oxygen product.

By generating additional nitrogen reflux and/or supplemental elevated pressure (i.e. intermediate pressure) nitrogen product from the intermediate pressure column, or kettle column, the present air separation unit system and method enables higher oxygen recovery, higher argon recovery with improved efficiency and reduce power consumption relative to conventional three column arrangements and many of the prior art intermediate column arrangements. On the McCabe-Thiele diagram of FIG. 1 for the conventional three column arrangement, the tight pinch in the upper portion of the lower pressure column is relieved by taking advantage of the excess distillation driving force in selected sections of the lower pressure column. In addition, one may also realize certain benefits, including an efficiency benefit in applications when the elevated pressure nitrogen gas product and/or liquid nitrogen product production rate is below 50% of the total oxygen production rate.

Figure 2:
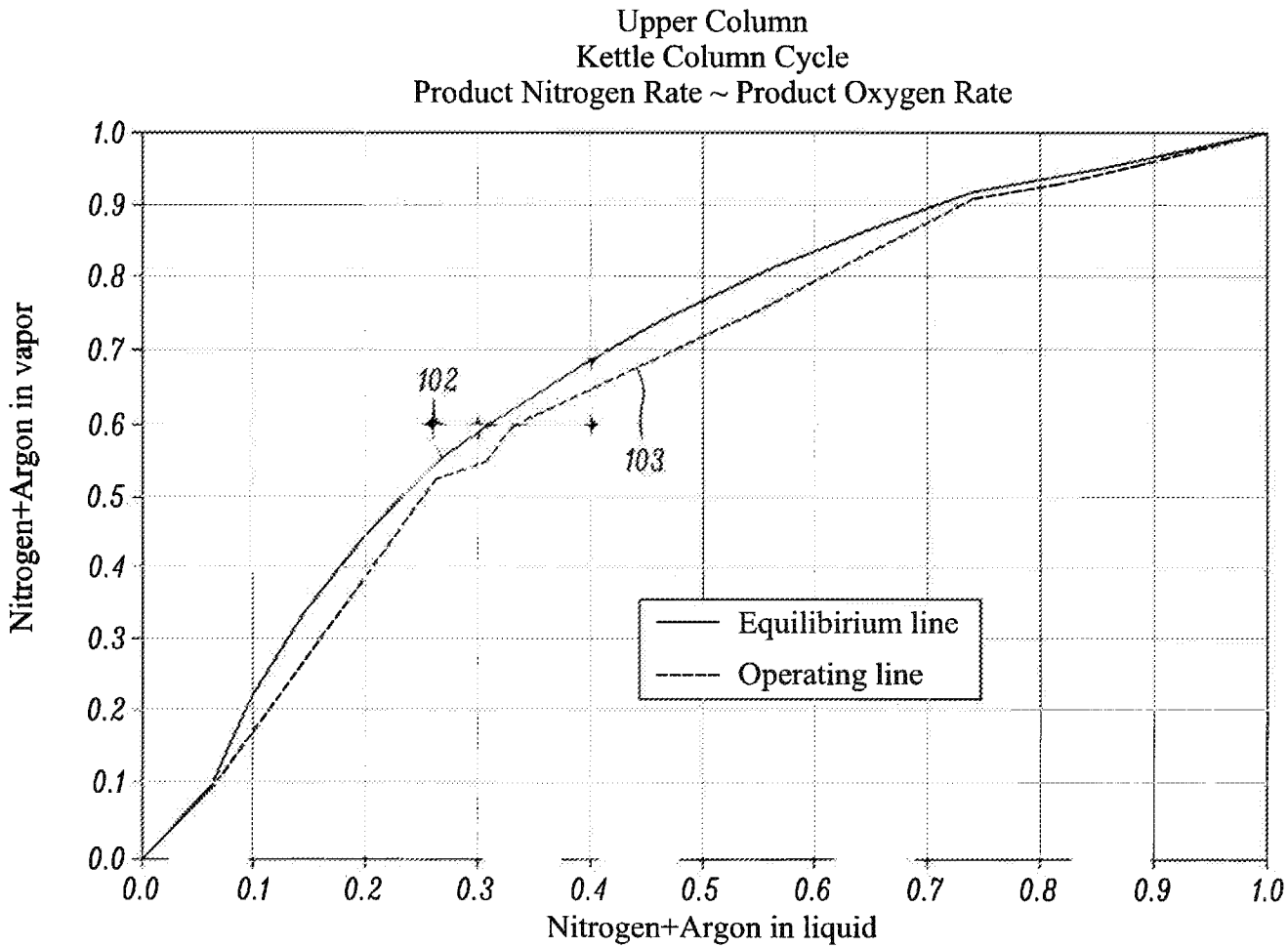
FIG. 2 depicts a McCabe-Thiele diagram for an embodiment of the present air separation unit and method comprising a four column arrangement including a higher pressure column, a lower pressure column, an intermediate pressure column, and an argon column.

FIG. 2 illustrates the McCabe-Thiele diagram for an embodiment of the present four column arrangement and cycle. As indicated above, the space between the equilibrium line 102 and the operating line 103 is indicative of the driving force for that portion of the column. Note that the mass transfer driving force in the section of the lower pressure column between the kettle liquid feed and argon column draw is reduced. The reduction in the mass transfer driving force in the section of the lower pressure column between the kettle liquid feed and argon column draw is achieved by driving the reboiler of the intermediate pressure column or kettle column with vapor from the base of this section of the lower pressure column, which is preferably the same source as the vapor that is fed from the lower pressure column to the argon column.

A key principle or characteristic of the present four column arrangement and associated air separation cycle is that: (1) the mass transfer driving force in the top section of the lower pressure column is increased by taking advantage of the excess driving force in the section between the kettle liquid feed and argon column draw; and (2) the mass transfer driving force of the bottom section of the lower pressure column is not reduced. In addition, the use of present four column arrangement and cycle reduces or avoids the need to draw product nitrogen from the top of the lower pressure column due to its ability to produce supplemental nitrogen product and/or nitrogen reflux from the intermediate pressure column.

Turning now to FIG. 3, there is shown an air separation unit 10 that comprises a warm end arrangement and a cold end arrangement that includes one or more heat exchangers and a distillation column system 30. As discussed in more detail below, the one or more heat exchangers preferably include at least a main heat exchanger 20 and a nitrogen superheater 21 or subcooler.

The warm-end arrangement is configured for conditioning a feed air stream for separation into its constituent components, namely argon, oxygen, and nitrogen, The warm-end arrangement receives a feed air stream, compresses the feed air stream in a series of main air compression stages and purifies the compressed air stream in a pre-purification unit to produce a compressed and purified air stream 12.

A first main portion of the compressed and purified air stream 12 is directed to the main heat exchanger 20 where it is cooled to temperatures suitable for rectification in the distillation column system 30 and exits the main heat exchanger as a cooled, compressed and purified stream 22. A second portion of the compressed and purified air stream 14 is further compressed in a first booster compressor 13 and cooled in aftercooler. A part of the further compressed second portion of the compressed and purified air stream is still further compressed in a second booster compressor 15 and cooled in aftercooler to yield a booster air stream 16 that is also directed to the main heat exchanger 20. The booster air stream 16 is cooled in main heat exchanger 20 to yield a liquid air stream 26 that is directed to the higher pressure column 40 of the distillation column system 30.

The remaining part of the further compressed first portion of the compressed and purified air stream is diverted as stream 18 that is further compressed in another booster compressor 17 to yield a turbine air stream 25 that is then partially cooled in main heat exchanger 20. The partially cooled stream is the expanded in turbine 27 yielding an exhaust stream 28 that is also directed to the higher pressure column 40 of the distillation column system 30. Note the exhaust stream 28 may be combined with the cooled, compressed and purified air stream 22.

The first portion of the compressed and purified air stream 12 as well as the turbine air stream 18 and booster air stream 16 are cooled in the main heat exchanger 20 via indirect heat exchange with a plurality of streams from the distillation column system 30 including: a clean shelf nitrogen stream 44; a pumped liquid oxygen stream 53; a pumped high pressure gaseous nitrogen stream 68; a waste nitrogen stream 59; and a low pressure gaseous nitrogen stream 52. The warmed streams exit the main heat exchanger 20 as: a product grade gaseous nitrogen stream 144; a product grade gaseous oxygen stream 153; a product grade high pressure gaseous nitrogen stream 168; a warmed waste nitrogen stream 159; and a product grade low pressure gaseous nitrogen stream 152.

The illustrated distillation column system 30 comprises: a higher pressure column 40, an intermediate pressure column or kettle column 70; a lower pressure column 50; an integrated argon condenser 65; an argon column 80; and a high ratio column 90.

The higher pressure column 40 configured to receive one or more streams of compressed, purified air including the liquid air stream 26, the cooled, compressed and purified air stream 22, as well as the exhaust stream 28 together with a reflux stream and yields a nitrogen-rich overhead 42, a clean shelf vapor stream 44, a dirty shelf nitrogen stream 46, a kettle liquid 48, and a synthetic liquid air stream 45 taken from an intermediate location of the higher pressure column 40.

The lower pressure column 50 is configured to receive the synthetic liquid air stream 45, an oxygen-rich bottoms 83 and or more reflux streams or other streams to yield a low pressure product grade nitrogen overhead 52, an oxygen liquid 51 at the bottom of the column to be taken as a liquid oxygen stream 53, and an argon-oxygen containing side stream 56 taken from an intermediate location of the lower pressure column 50. A portion of the liquid oxygen stream 53 may be taken as a liquid oxygen product 154 while the majority of the liquid oxygen stream 53 is pumped via pump 55 and vaporized in the main heat exchanger to produce the gaseous oxygen product 153. The one or more reflux streams introduced into the lower pressure column 50 preferably include stream 78B from the kettle column condenser 75 and the dirty shelf nitrogen stream 46 from the higher pressure column 40 which streams may be combined to yield a mixed shelf reflux stream 47. The purity of the dirty shelf nitrogen streams 78B, 46 from the higher pressure column 40 and from the kettle column 70 is optimized for feed to the lower pressure column 50 at or near the location where waste nitrogen is withdrawn from the lower pressure column.

The lower pressure column 50 also houses a main condenser-reboiler configured for thermally coupling higher pressure column 40 and lower pressure column 50 by liquefying at least a portion of the nitrogen-rich overhead 42 from the higher pressure column 40 against the oxygen liquid 51 at the bottom of the lower pressure column 50 to yield a nitrogen reflux stream 62 directed to the higher pressure column 40 and another nitrogen stream 61, a portion of which is directed as reflux stream 63 to the top of the lower pressure column 50. Another portion of nitrogen stream 61 is preferably taken as high pressure product grade nitrogen stream 68 that is pumped via pump 67 and directed to the main heat exchanger 20 while the remaining portion of nitrogen stream 61 is preferably taken as a liquid nitrogen product stream 164.

A once-through argon condenser is also disposed within the lower pressure column 50 at a location above the intermediate location of the lower pressure column. The argon condenser is configured to condense an argon-rich overhead taken from the argon column against all or a portion of the descending liquid in the lower pressure column 50 including feed streams 79, 97, 98, and optionally a diverted portion 66 of the liquid air stream 45 to produce a crude argon stream 69, a portion of which is a reflux stream 81 for the argon column 80.

In some cases, it may be preferred to use the diverted portion of the subcooled synthetic liquid air 66 to further increase the temperature driving force of the argon condenser 65. Doing this introduces this liquid air to a non-ideal location within the lower pressure column, resulting in a small penalty in argon recovery. Unlike the prior art systems and methods, using a small, diverted portion of the subcooled synthetic liquid air 66 to drive the argon condenser 65 in the present air separation unit and method can enable a further increase in the driving force of the kettle column reboiler 71 and kettle column condenser 75. When this is desirable, it results in a further increase in oxygen recovery and a further reduction in power consumption.

An intermediate pressure column or kettle column 70 is configured to receive the kettle liquid 48 from the higher pressure column 40 and yield an oxygen-rich kettle bottoms 72 and a nitrogen rich kettle overhead 76A. The kettle liquid 48 is preferably subcooled in the nitrogen superheater 21 and routed through the high ratio column reboiler 95. Preferably, the subcooled kettle liquid 48 is then introduced into the kettle column 70, preferably at an intermediate location of the kettle column several stages above the bottom section. Operatively associated with the kettle column 70 is a once-through kettle column reboiler 71 and a once-through kettle column condenser 75. The once-through kettle column reboiler 71 is configured to boil a portion of the descending liquid in the kettle column 70 against a first part 58 of the argon-oxygen side stream 56 to yield an ascending vapor stream in the kettle column 70 and an argon-oxygen liquid stream 77 that is returned at or near the intermediate location of the lower pressure column 50. For that reason, the kettle column 70 is spatially disposed preferably above the intermediate location of lower pressure column 50 so that the return liquid from the kettle column reboiler and the transferred kettle can be fed to the lower pressure column 50 by gravity. Also, unlike some of the prior art disclosures related to intermediate pressure columns, none of the synthetic liquid air or liquid air feed is directed to the kettle column.

The once-through kettle column condenser 75 is configured to condense all or a portion of the nitrogen rich kettle overhead 76A of the kettle column 70 against a first major portion 73 of the oxygen-rich kettle bottoms 72 of the kettle column 70 to yield a nitrogen reflux stream 78A for the kettle column 70, a shelf nitrogen liquid stream 78B and a boil-off vapor stream or transferred kettle stream 79 that is returned to the lower pressure column 50. The first major portion 73 of the oxygen-rich kettle bottoms 72 is let down in pressure and then fed to the Kettle Column condenser 75. The remaining or second minor portion 74 of the oxygen-rich kettle bottoms 72 of the kettle column 70 is also let down in pressure and preferably directed to a high ratio column condenser 96.

In the disclosed embodiment of FIG. 3, the kettle column 70 preferably has between 15 stages and 30 stages of separation and can use either structured packing or trays, although structured packing is preferred. When using only between 15 stages and 30 stages of separation, the shelf nitrogen stream 78B taken from the kettle column 70 is of a lower purity and referred to as a dirty shelf nitrogen stream. In this embodiment, the pressure of the intermediate pressure column or kettle column 70 is set by the temperature differences of the kettle column condenser 75 and kettle column reboiler 71, typically in the range of about 2 bara to 3 bara.

As indicated above, the kettle column of FIG. 3 produces dirty shelf liquid nitrogen reflux. The dirty shelf nitrogen stream 78B augments the dirty shelf reflux stream 46 produced by the higher pressure column 40 and forms the mixed reflux stream 47 for the lower pressure column 50.

The dirty shelf liquid configuration of FIG. 3 maximizes the power savings of the air separation unit 10 but sacrifices some argon recovery compared to other configurations that use a higher purity nitrogen stream or clean shelf nitrogen stream from the kettle column having more than 30 stages of separation.

The argon column 80 is configured to receive a second part 57 of the argon-oxygen side stream 56 from the lower pressure column 50 and yield an argon-rich overhead 82 that is directed to the once through argon condenser 65 and an oxygen-rich bottoms 83 that is returned at or near the intermediate location of the lower pressure column 70.

The high ratio column 90 is configured to receive a portion 84 of the crude argon stream 69 from the once-through argon condenser 65 and rectify the portion 84 of the crude argon stream 69 to yield an argon-rich liquid 94 and an overhead vapor 92. A portion of the argon-rich liquid 94 at the bottom of the high ratio column 90 is taken as liquid argon product 194. Associated with the high ratio column 90 is a high ratio reboiler 95 and a high ratio column condenser 96. The high ratio column reboiler 95 is disposed at the bottom of the high ratio column 90 and configured for reboiling another portion of the argon-rich liquid at the bottom of the high ratio column 90 against a stream of the kettle liquid 48 to produce an ascending vapor stream in the high ratio column 90. The high ratio column condenser 96 is configured to condense the overhead vapor 92 from the high ratio column 90 and return all or a portion of the condensate as a high ratio column reflux stream 97. All or a portion of the high ratio column condenser boil-off vapor 98 as well as a portion of the excess condensing media 99 is be returned to the lower pressure column 50. Together the argon column 80, the high ratio column 90, the once-through argon condenser 65, the high ratio column reboiler 95, and the high ratio column condenser 96 make up an argon column arrangement.

It is essential that the argon condenser 65 is once-through on the boiling side and this feature provides a large advantage over the prior art disclosures of four column arrangements, due in part, to the impure boiling stream. A once-through up-flow configuration for the argon condenser 65 is preferred due to its lower cost and simplicity, although a once-through downflow configuration for the argon condenser 65 would also provide an advantage.

A key difference between the present air separation unit and associated methods and those disclosed in the prior art references related to four column arrangements with an intermediate pressure column, is the argon condenser 65 is an integrated unit disposed within the lower pressure column and therefore not directly coupled to the kettle column. By locating the Argon condenser within the lower pressure column, the boiling flow through the argon condenser is much greater, and by locating the argon condenser at the optimal location in the lower pressure column, the composition of the boiling stream (i.e. descending liquid) can be higher in nitrogen content. The optimal location for the argon condenser within the lower pressure column is such that the ΔT of the argon condenser does not limit the ability to drive the kettle column before the ATs of the kettle column reboiler and kettle column condenser, while not penalizing the separation within the lower pressure column, for example, by locating argon condenser too high within column.

The benefit of using the once-through kettle column reboiler and kettle column condenser, as well as the integrated once-through argon condenser is large. This configuration naturally increases the temperature differences of each device due to the lower purity boiling streams compared to a pool boiling (i.e. thermosyphon) configurations for such devices. But rather than designing and operating the air separation cycle with large temperature differences, which would make the kettle column reboiler, kettle column condenser, and argon condenser smaller, and save some capital cost, it is far better to use these larger temperature driving forces to dramatically increase the capacity of the intermediate pressure column or kettle column. Increasing the capacity of the kettle column results in much more liquid reflux production (or product nitrogen generation) from the kettle column, and a much larger advantage for its use. The greater production of nitrogen from the kettle column means that the oxygen-rich kettle bottoms 72 is richer in oxygen. This results in reduced temperature differences in the kettle column reboiler, kettle column condenser, and argon condenser. Ultimately, size and minimum temperature difference design constraints of these devices limit the capacity of the kettle column, but at a much greater magnitude in this configuration than for the prior art.

The transferred kettle stream 79 exiting the kettle column condenser 75 is fed to the lower pressure column 50. The transferred kettle stream 79 is likely a two phase stream and it may be transferred to the lower pressure column as a two phase stream or it may be separated in a phase separator (not shown) before transferring to the lower pressure column 50. If a phase separator is used, then the kettle column condenser 75 may be contained within the phase separator. In the illustrated embodiment, the transferred kettle stream 79 is preferably fed to the lower pressure column 50 just above the location of the integrated once-through argon condenser 65. Within the lower pressure column 50 the liquid portion of the transferred kettle stream 79 is combined with the downflowing liquid in the lower pressure column 50.

Similar to the argon condenser, it is essential that both the kettle column reboiler and kettle column condenser are once-through on the boiling side, A once-through up-flow configuration of the kettle column reboiler as well as the kettle column condenser is preferred. A once-through downflow configuration for the kettle column reboiler and kettle column condenser would provide some additional advantage but will be more costly and would probably not be justified in most cases. Due to the large feed liquid flow to the boiling side of the once-through kettle column reboiler, the vapor fraction of the exiting fluid is low. This means that the once-through up-flow or once through downflow configurations can be used safely. With the once through up-flow or downflow kettle column reboiler, the vapor fraction of its outlet is minimized which enables the kettle column reboiler to operate at high duty with an appropriate ΔT so that its size is reasonable, and within safe operating criteria with its walls being sufficiently wetted. For the kettle column condenser and argon condenser similar points can be made. They handle the feed of large liquid flow rates. As a result, the vapor fraction exiting is low. This enables safe operation and maximizes the ΔT at a given heat duty.

Since the boiling fluid within the kettle column reboiler is very impure, a once-through kettle column reboiler provides a large benefit. If a pool boiler (i.e., thermosyphon reboiler) were used instead, the boiling flow would be significantly higher in oxygen concentration which would decrease its ΔT. The resulting penalty would be a greatly reduced ability to drive the kettle column, with much less production of nitrogen. The kettle column reboiler is preferably driven by the same vapor source from the lower pressure column that feeds the argon column. Also, the liquid returned from the kettle column condenser is fed to the same general location in the lower pressure column as the vapor source.

Unlike some of the prior art disclosures related to four column arrangements with an intermediate pressure column which splits the oxygen-rich kettle bottoms between the kettle column condenser and the argon condenser severely limiting the kettle column capacity, none of the oxygen-rich kettle bottoms 72 in the present air separation unit and method are directed to the argon condenser 65. Rather, the oxygen-rich kettle bottoms 72 are supplied mainly to kettle column condenser except for a minor takeoff that is directed to high ratio column condenser, if it is used.

Figure 4:
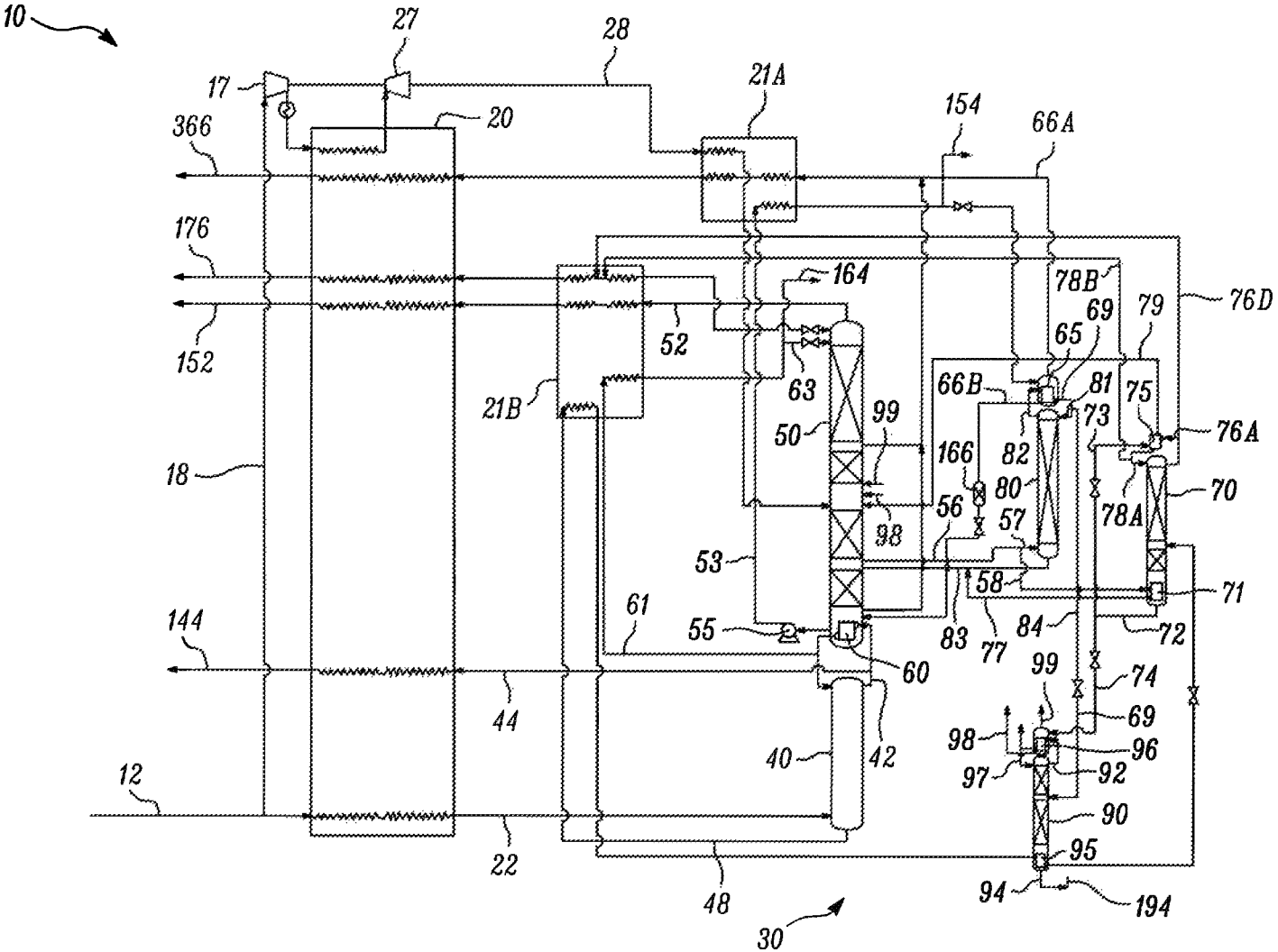
FIG. 4 shows a schematic of the process flow diagram for an embodiment of a nitrogen and argon producing air separation unit and associated method of air separation having a distillation column system that includes an intermediate pressure kettle column.

In some respects, the process flow diagrams depicted in FIG. 4 is somewhat similar to the process flow diagram of FIG. 3 described above, and for sake of brevity, much of the descriptions of the detailed arrangements of the intermediate pressure kettle column will not be repeated. Rather, the following discussion will focus on the key features of the nitrogen and argon producing air separation unit shown in FIG. 4 and the differences in the process flow diagram of the depicted in FIG. 4 when compared to the process flow diagram depicted in FIG. 3.

As indicated above, there is a need for enhancements to nitrogen and argon producing air separation units in order to potentially reduce power costs while concurrently improving argon recovery and ensuring sufficient availability of higher purity nitrogen product streams. One such improvement is the use of an intermediate pressure kettle column to further fractionate the kettle liquid from the higher pressure column which improves the available liquid nitrogen reflux to the lower pressure column and a higher purity nitrogen vapor product stream at an intermediate or elevated pressure.

Similar to the air separation unit in FIG. 3, the mass transfer driving forces in portions of the lower pressure column of the air separation unit 10 depicted in FIG. 4 are unnecessarily high and one can exploit this feature by using vapor stream 58 originating from an intermediate location of the lower pressure column 50 to produce vapor in the bottom of the intermediate pressure kettle column via the kettle column reboiler 71 and by using the liquid bottoms from the intermediate pressure kettle column 70 to condense the nitrogen overhead 76A from the intermediate pressure kettle column 70 in the kettle column condenser 75 to produce liquid nitrogen streams 78A,78B.

Also, similar to the embodiment discussed with reference to FIG. 3, the kettle column reboiler 71 and kettle column condenser 75 in the embodiment of FIG. 4 are once through devices. Since the boiling stream in the kettle column reboiler 71 and the kettle column condenser 75 are of mixed purity, once through designs lead to much larger ΔTs than arrangements using pool boilers. The best way to benefit from this is to drive the kettle column reboiler 71 and kettle column condenser 75 to a maximum level, limited by the ΔT or other sizing criteria. This maximizes the benefit realized by the intermediate pressure kettle column 70. Once through up-flow devices are usually preferred for the kettle column reboiler 71 and the kettle column condenser 75. Once through downflow devices may provide slightly more benefit, but usually the cost to build them is considerably higher. The vapor fraction on the boiling side is quite low in the kettle column reboiler 71 and kettle column condenser 75 which allows safe operation of kettle column reboiler 71 and kettle column condenser 75 as the devices will not approach unsafe operating conditions such as boiling to dryness.

Unlike the arrangements suited for production of normal purity oxygen as shown in FIG. 3, the configuration depicted in FIG. 4 focuses on production of high purity nitrogen and argon wherein the argon condenser 65 is refrigerated by liquid oxygen 53 pumped via pump 55 from the bottom of the lower pressure column 50. If desired, a portion of the pumped liquid oxygen may be taken as liquid oxygen product 154. As such, this configuration or arrangement is generally not dependent on the driving forces in the intermediate pressure kettle column 70 and the duties of the kettle column reboiler 71 and kettle column condenser 75, as is the case for configuration depicted in FIG. 3. For this reason as well as safety reasons, the argon condenser 65 is a pool boiling type design because the liquid oxygen in the argon condenser 65 is nearly fully vaporized with the resulting boil-up stream 66A being warmed in superheater 21A and main heat exchanger 20 to yield a waste oxygen stream 366.

Another difference is that the higher pressure column 40 in FIG. 4 does not yield a synthetic liquid air stream that is directed to the lower pressure column 50. Rather, a portion of the compressed, purified feed air is diverted through a turbine air circuit. The diverted portion of feed air 18 is further compressed in booster compressor 17, aftercooled and then partially cooled in the main heat exchanger 20. The partially cooled turbine air stream is then expanded in turbo-expander 27 with the resulting exhaust stream 28 being subcooled in superheater 21A and introduced into the lower pressure column 50 at an intermediate location.

In addition to the withdrawal of product nitrogen stream 52 from lower pressure column 50, optional elevated pressure streams 76D, and/or 44, from kettle column 70 and higher pressure column 40, respectively, may be withdrawn. Elevated pressure nitrogen vapor stream 44 is preferably drawn from the higher pressure column 40, warmed in the main heat exchanger 20 and taken as an elevated pressure product nitrogen vapor stream 144. In addition, a portion of the nitrogen overhead 76D from the intermediate pressure kettle column 70 is warmed in superheater 21B and the main heat exchanger 20 and then taken as another elevated pressure product nitrogen stream 176. One can optimize the nitrogen product purity from the air separation unit 10 by selecting the appropriate rates and flows of these elevated pressure product nitrogen stream 176. Withdrawing shelf nitrogen vapor 76D from the intermediate pressure kettle column 70 allows greater product nitrogen rates than from the higher pressure column 40, and the argon recovery from the air separation unit 10 will tend to be higher. However, this intermediate pressure nitrogen stream 76D and 176 may need further compression in a downstream nitrogen compressor to meet the product slate requirements. Withdrawing the elevated pressure product nitrogen vapor stream 44 from the higher pressure column 40 has the benefit of higher suction pressure into the nitrogen compressor (not shown) which reduces the overall power consumption of the air separation unit depending on the nitrogen product slate requirements. Although not shown, in addition to the withdrawal of elevated pressure nitrogen streams, an oxygen stream may be taken from the lower pressure column, pumped to sufficient pressure and then vaporized in the main heat exchanger to produce a gaseous oxygen product stream.

Also shown in the embodiment of FIG. 4 is a recirculating circuit disposed between the argon condenser 65 and the lower pressure column 50. The recirculating circuit is configured for directing a liquid oxygen-rich stream 66B from the argon condenser 65 to the sump of the lower pressure column 50. A gel trap 166 is also disposed in the recirculating circuit and configured to receive the liquid oxygen-rich stream 66B from the argon condenser and removing carbon dioxide, nitrous oxide, or other contaminants from the liquid oxygen-rich stream. An alternative to the recirculating circuit and gel trap is to simply to drain a small flow of liquid oxygen from the argon condenser but draining the liquid oxygen would add to the air separation unit refrigeration demand.

While the present invention has been described with reference to a preferred embodiment or embodiments, it is understood that numerous additions, changes and omissions can be made without departing from the spirit and scope of the present invention as set forth in the appended claims.

What is claimed is:

1. An air separation unit for production of nitrogen and argon from a source of purified, compressed feed air, the air separation unit comprises a distillation column system comprising:

a higher pressure column configured to receive the air steam and a first reflux stream and yield a nitrogen-rich overhead and a kettle liquid;

a lower pressure column configured to receive the exhaust stream and a second reflux stream and yield a low pressure product grade nitrogen overhead, an oxygen liquid bottoms, and an argon-oxygen side stream;

a main condenser-reboiler disposed in the lower pressure column and configured for thermally coupling the higher pressure column and the lower pressure column by liquefying at least a portion of the nitrogen-rich overhead from the higher pressure column against oxygen liquid bottoms in the lower pressure column to yield the first reflux stream and the second reflux stream;

an intermediate pressure kettle column arrangement comprising a kettle column configured to receive the kettle liquid from the higher pressure column at an intermediate location of the kettle column and yield an oxygen-rich bottoms and a nitrogen rich overhead;

the intermediate pressure kettle column arrangement further comprises a once-through kettle column reboiler configured to boil a portion of the descending liquid in the kettle column against a first part of the argon-oxygen side stream to yield an ascending vapor stream in the kettle column and an argon-oxygen liquid stream that is returned to an intermediate location of the lower pressure column;

the intermediate pressure kettle column arrangement further comprises a once through kettle column condenser configured to condense all or a portion of the nitrogen rich overhead of the kettle column against a portion of the oxygen-rich bottoms of the kettle column; and an argon column arrangement comprising one or more argon columns and an argon condenser, the argon column is configured to receive a second part of the argon-oxygen side stream from the lower pressure column and yield an argon-rich overhead and an oxygen-rich liquid stream that is returned to the intermediate location of the lower pressure column;

wherein the argon condenser is configured to condense the argon overhead against a portion of the oxygen liquid bottoms from the lower pressure column.

2. The air separation unit of claim 1, wherein the once through kettle column condenser is configured to condense a first portion of the nitrogen rich overhead of the kettle column against a first portion of the oxygen-rich bottoms of the kettle column and wherein a second portion of the nitrogen rich overhead of the kettle column is taken as an intermediate pressure nitrogen product stream.

3. The air separation unit of claim 1, wherein a first portion of the condensate from the once through kettle column condenser is directed as reflux to the kettle column and a second portion of the condensate from the once through kettle column condenser is directed to the lower pressure column as a third reflux stream.

4. The air separation unit of claim 1, wherein a stream of liquid oxygen is taken from the argon condenser and directed to the bottom of the lower pressure column.

5. The air separation unit of claim 4, further comprising a gel trap disposed between the argon condenser and the lower pressure column and configured to remove heavy impurities from the stream of liquid oxygen taken from the argon condenser.

6. The air separation unit of claim 1, wherein the kettle column is configured to receive the kettle liquid at an intermediate location of the kettle column.

7. The air separation unit of claim 1, wherein the argon column arrangement further comprises:

a first argon column configured to receive the second part of the argon-oxygen side stream from the lower pressure column and yield the argon-rich overhead and the oxygen-rich bottoms that is directed back to the lower pressure column;

argon condenser is configured to receive the argon-rich overhead from the first argon column and condense the argon-rich overhead to produce a crude argon stream; and a high ratio column configured to receive a portion of the crude argon stream from the argon condenser and rectify the portion of the crude argon stream to yield an argon-rich liquid and an overhead vapor;

wherein a portion of the argon-rich liquid at the bottom of the high ratio column is taken as liquid argon product.

8. The air separation unit of claim 7, wherein the argon column arrangement further comprises:

a high ratio column reboiler is disposed at the bottom of the high ratio column and configured for reboiling another portion of the argon-rich liquid at the bottom of the high ratio column to produce an ascending vapor stream in the high ratio column; and a high ratio column condenser is configured to condense the overhead vapor from the high ratio column and return all or a portion of the condensate as a high ratio column reflux stream.

9. The air separation unit of claim 1, further comprising:

a main air compression arrangement configured to receive a feed air stream and compress the feed air stream in a series of main air compression stages to yield a compressed feed air stream;

a pre-purification unit configured to remove contaminants and water vapor from the compressed feed air stream to yield the purified, compressed feed air stream;

wherein the purified, compressed feed air stream is split into one or more streams of purified, compressed air; and a main heat exchanger configured to cool the one or more streams of purified, compressed air via indirect heat exchange against one or more nitrogen product streams and waste streams, an upper column turbine configured to expand one of the cooled streams of purified, compressed air to produce an exhaust stream that is directed to the lower pressure column.

10. The air separation unit of claim 9, wherein a portion of the liquid oxygen in the lower pressure column is pumped and then warmed in the main heat exchanger and taken as a gaseous oxygen product stream.

11. The air separation unit of claim 9, wherein a portion of the nitrogen-rich overhead of the kettle column is warmed in the main heat exchanger and taken as an intermediate pressure nitrogen vapor product stream.

12. The air separation unit of claim 11, wherein a portion of the nitrogen-rich overhead from the higher pressure column is warmed in the main heat exchanger taken as a higher pressure nitrogen vapor product stream.

* * * * *